US009764359B2

(12) United States Patent
Cappozzo

(10) Patent No.: US 9,764,359 B2
(45) Date of Patent: Sep. 19, 2017

(54) SCREEN FOR SEPARATING SOLID MATERIALS

(71) Applicant: ECOSTAR S.R.L., Sandrigo (IT)

(72) Inventor: Domenico Cappozzo, Sandrigo (IT)

(73) Assignee: ECOSTAR S.R.L., Sandrigo (IT)

( * ) Notice: Subject to any disclaimer, the term of this patent is extended or adjusted under 35 U.S.C. 154(b) by 0 days.

(21) Appl. No.: 15/189,014

(22) Filed: Jun. 22, 2016

(65) Prior Publication Data

US 2016/0368025 A1 Dec. 22, 2016

(30) Foreign Application Priority Data

Jun. 22, 2015 (IT) ..... 102015000026357

(51) Int. Cl.

| | |
|---|---|
| ***B07B 4/08*** | (2006.01) |
| ***B07B 1/15*** | (2006.01) |
| ***B08B 15/02*** | (2006.01) |
| *B07B 11/02* | (2006.01) |

(52) U.S. Cl.

CPC ..... *B07B 4/08* (2013.01); *B07B 1/15* (2013.01); *B07B 1/155* (2013.01); *B08B 15/02* (2013.01); *B07B 11/02* (2013.01); *B08B 2215/003* (2013.01)

(58) Field of Classification Search

CPC .. B07B 1/15; B07B 1/155; B07B 4/08; B07B 11/02; B08B 15/02

USPC ..... 209/28, 643

See application file for complete search history.

(56) References Cited

U.S. PATENT DOCUMENTS

| | | | | |
|---|---|---|---|---|
| 1,233,965 A * | 7/1917 | Bishop et al. | F26B 15/22 209/27 |
| 3,164,548 A * | 1/1965 | Rowell | A24B 5/10 209/139.1 |
| 4,737,270 A * | 4/1988 | Phelps | B07B 11/04 209/138 |
| 4,913,804 A * | 4/1990 | Muller | B03B 4/02 209/312 |
| 5,040,353 A * | 8/1991 | Evans | B07C 5/3404 209/644 |

(Continued)

FOREIGN PATENT DOCUMENTS

| | | |
|---|---|---|
| AU | 2007203145 B2 | 7/2012 |
| CH | 700389 A2 | 8/2010 |

(Continued)

*Primary Examiner* — Joseph C Rodriguez

(74) *Attorney, Agent, or Firm* — Mark M. Friedman

(57) ABSTRACT

Screen for separating solid residues, and in particular for separating sheet or expanded material, such as bags or parts of bags made of plastic, polystyrene, spongy material or another light material, which comprises a separation station (10) interposed between the inlet port (P1) and the outlet port (P2) of the screen above its screening surface (P) and preferably after the powders and the lightest portions have already been separated. The station (10) comprises a hood (11) delimiting a suction chamber (13), and insufflation means (15) for orienting at least one lifting air flow (16) in the suction chamber (13) at the screening surface (P). The lifting air flow (16) is oriented for forming a vortex (17) confined in said suction chamber (13) and with rotation axis (Z) orthogonal to the screening surface (P) capable of lifting the sheet material and delivering it to suction means (18) associated with the hood (11).

9 Claims, 8 Drawing Sheets

(56) References Cited

U.S. PATENT DOCUMENTS

| | | | | |
|---|---|---|---|---|
| 5,772,045 | A * | 6/1998 | Zanarini | B07C 5/3404 209/139.1 |
| 5,875,898 | A * | 3/1999 | Fry | B07B 4/08 209/28 |
| 6,435,191 | B1 * | 8/2002 | Roudabush | A24B 5/10 131/108 |
| 7,243,801 | B2 * | 7/2007 | Posner | B07B 4/08 198/818 |
| 8,016,115 | B2 * | 9/2011 | Fryars | B07B 4/08 15/345 |
| 8,172,087 | B2 * | 5/2012 | Fryars | B07B 4/08 209/133 |
| 8,517,177 | B2 * | 8/2013 | Graham | B03B 9/061 209/12.1 |
| 2010/0230330 | A1 * | 9/2010 | Afsari | B07B 15/00 209/680 |
| 2010/0288680 | A1 | 11/2010 | Campbell et al. | |
| 2012/0325729 | A1 * | 12/2012 | Cappozzo | B07B 1/15 209/369 |

FOREIGN PATENT DOCUMENTS

| | | | |
|---|---|---|---|
| DE | 3148475 | A1 | 9/1982 |
| EP | 1180401 | A2 | 2/2002 |

* cited by examiner

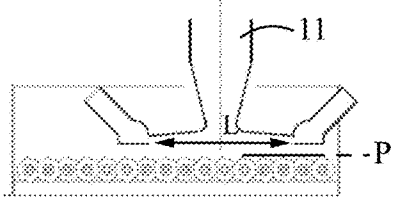
Fig. 7A
Fig. 7B
Fig. 7C
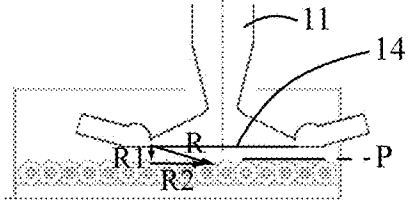
Fig. 8A
Fig. 8B
Fig. 8C
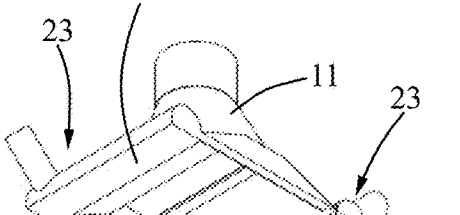
Fig. 9A
Fig. 9B
Fig. 9C

SCREEN FOR SEPARATING SOLID MATERIALS

FIELD OF APPLICATION

The present invention regards a screen for separating solid materials, according to the preamble of the independent main claim.

The present screen is intended to be employed, in a per se conventional manner, for separating solid materials of various type in which materials are present in thin sheet form, to be separated from the remaining mass of residues. The present screen can therefore be employed for treating, for example: solid urban waste, fluvial material, products of the organic fractions of separate waste (recycling) collection, compost (for its refining), recycled wood, biomass, inert material, demolition material, land reclaiming material and dumping material, glass, plastic, metal scrap material and still other materials, in which thin materials are present such as plastic sheets, plastic bags, i.e. materials provided with a mainly sheet-like extension, and for such reason provided with a small weight in relation to a large surface area, or materials provided with an expanded extension like sponges.

The screen according to the invention is therefore mainly but not exclusively inserted in the industrial field of treatment of solid residues and is advantageously intended to be installed downstream of plants for crushing or grinding the same residues.

STATE OF THE ART

Hereinbelow, with the term "residues", any one solid material will be indicated in an undifferentiated manner and for the sake of brevity, such material requiring separation into its components based on size or mass. With the term "sheet material", it must be intended that component of the residues mainly constituted by plastic bags or parts thereof, belts, films, films in particular made of plastic but also of other materials characterized by an extremely thin thickness and light with respect to an extension area, and for this reason significantly affected by the friction with air.

Numerous different apparatuses are known on the market which are intended to be employed for the separation of the solid residues in multiple fields of application, in addition employing different structural and operational principles. Among such apparatuses we recall the following, for example: mesh screens, screw screens, disc screens, drum screens, ballistic separators, fluid bed separators, electrostatic separators, agnetic separators and still other apparatuses.

The present invention preferably, even if not exclusively, also refers to vibrating in particular of disc type, as described for example in the patent U.S. Pat. No. 4,972,959, EP 1106264 and EP 2488306. The invention can nevertheless also regard a different type of screen, such as a screw screen, a rotary screen or a simple conveyor belt which accomplishes the role of screen due to that provided by the present invention, as specified hereinbelow.

More in detail, disc screens are known, for example, comprising numerous equidistant parallel shafts that are rotatably mounted on a support structure and each bearing a disc group. The latter are separated from each by a distance smaller than the thickness of the single discs in order to allow interposing the discs mounted on the contiguous shafts.

The residues are discharged on the screening discs, which advance them in a jerking manner from an inlet section to an outlet section with an advancing motion according to the longitudinal extension axis of the screen, substantially orthogonal to the support shafts of the discs.

The openings delimited between the discs and the rotating shafts define the screening area indicative of the size of the residues which are separated by the screen, falling by gravity below the screening surface.

Mesh screens are also known in which a netting provided with meshes, with width equal to the desired screening area, receives the residues to be treated. The mesh is supported by a support structure, usually in a tilted manner, and is operatively susceptible of vibrating in order to separate the residues during their advancing from an inlet section, generally higher, to an outlet section, generally lower.

The screens described up to now of known type are able to separate the residues usually based on their size, by exploiting the gravitation force that allows them to fall between the discs and the meshes, so as to differentiate the collection during the advancing thereof.

The above-indicated screens of known type have in practice demonstrated that they do not lack drawbacks, since they are substantially unsuitable for separating, from the rest of the residues, material provided with a thin sheet form such as in particular plastic material in film form, in sheet form or in any case with very thin thickness with respect to a substantial planar extension thereof.

Such sheet material floats above the surface of the screen, whether this is obtained with a mesh or with a plurality of discs, and in any case reaches the outlet section without having been separated. Such sheet material can represent waste matter or a resource if opportunely separated from the rest of the residues.

In order to overcome this drawback, improved screens are known which provide for separating such sheet material from the rest of the residues, by mounting aspirators above the screening surfaces that are capable of lifting the sheet material itself, removing it from the advancing residue material.

Once suctioned, the material can be separated in a per se known manner, for example through centrifugal systems, or in plenum chambers which slow the speed of the transport vector air flow, allowing the sheet material to fall into a collection point.

In practice, also such improved screens have shown considerable operating limits, in particular connected with ability to select the sheet material from another residue material which, while light, is not homogeneous with that made of sheet material that is to be separated (e.g. it is not made of plastic).

In order to attempt to remedy this problem, such screens usually provide for varying the area of the suction mouth by actuating the movement of lateral deflectors, without however being able to sufficiently differentiate the sheet material to be selected.

Known from patent AU 2007203145 is an apparatus for separating solid residues, which comprises a conveyor belt for conveying the solid residues to be separated and a separation station for separating sheet material that intercepts the conveyor belt. Such station is arranged superimposed on the conveyor belt and delimits a chamber where insufflation means are provided, which inject air not at the surface of the conveyor belt but high above this, creating a vortex which is extended from top to bottom and which provides for making the light particles fall downward.

Suction means are also provided in the separation station which are not adapted to suction sheet or expanded material, since these are usually arranged for adjusting the reduced pressure at the center of the vortex.

Such apparatus provides for creating a descensional vortex which generates a reduced pressure at its interior adapted to lift the material from the screening surface, before then radially expelling such material from the lower mouth of the station, making it fall to the sides of the conveyor belt. Such screening system does not allow correctly separating the light material, creating a vortex that is not functional for such operation.

PRESENTATION OF THE INVENTION

In this situation, the problem underlying the present invention is therefore that of eliminating the problems of the abovementioned prior art, by providing a screen for separating solid materials which is able to optimally separate homogeneous sheet material from the remaining residues.

Another object of the present invention is to provide a screen for separating solid materials which is simple and inexpensive to obtain and entirely reliable in operation.

Another object of the present invention is to provide a screen for separating solid materials which is employable in a versatile manner in different application settings.

BRIEF DESCRIPTION OF THE DRAWINGS

The technical characteristics of the finding, according to the aforesaid objects, can be clearly seen in the contents of the below-reported claims and the advantages thereof will be clearer in the following detailed description, made with reference to the enclosed drawings, which represent a merely exemplifying and non-limiting embodiment of the invention, in which:

FIGS. 7A-7C shows a detail of the present invention relative to a separation station with a hood provided with adjustable mouth and illustrated in three different adjustment positions;

FIGS. 8A-8C shows a detail of the present invention relative to a separation station with injectors connected to the hood provided with adjustable angle and illustrated in three different adjustment positions;

FIGS. 9A-9C show a detail of the present invention relative to a separation station with injectors connected to the hood through a manifold provided with three different openings.

DETAILED DESCRIPTION OF A PREFERRED EMBODIMENT

Figure 2:
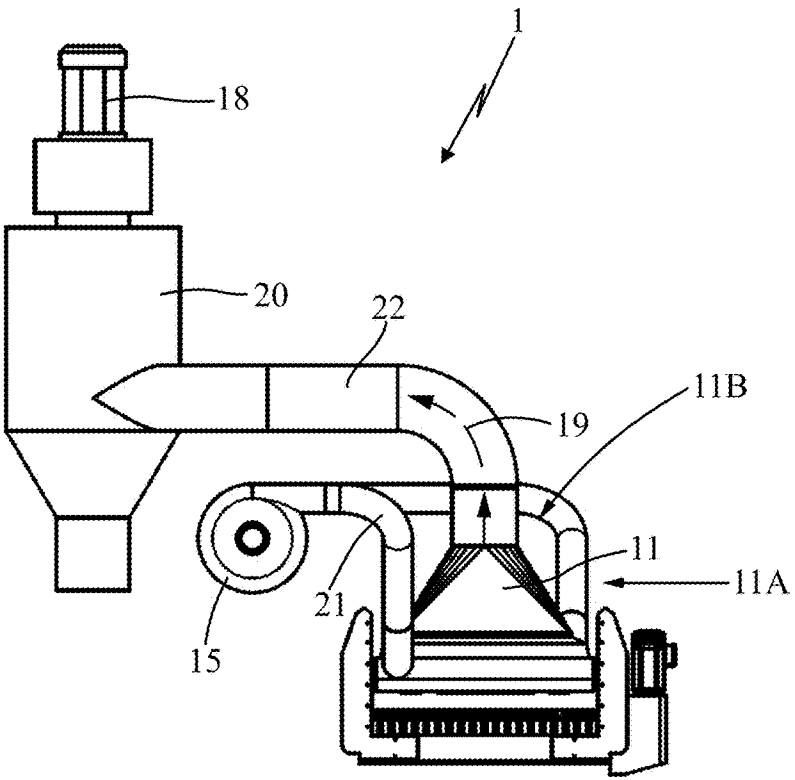
FIG. 2 schematically shows a side image of the screen of FIG. 1.

With reference to the set of drawings, reference number 1 overall indicates a screen for separating solid materials, object of the present invention.

The screen 1 according to the invention is adapted to be employed for separating solid materials of various types, hereinbelow termed "residues", and in particular for separating sheet material or expanded material therefrom.

Hereinbelow with the term "residues", any one solid material will be indicated in an undifferentiated manner and for the sake of brevity, such material requiring separation into its components based and including: solid urban waste, fluvial material, products of the organic fractions of separate waste (recycling) collection, compost (for its refining), recycled wood, biomass, inert material, demolition material, land reclaiming material and dumping material, glass, plastic, metal scrap material and still other materials. Residues can also be composed of materials that have already sustained a selection process, such as a separate waste collection (recycling) process of dry material.

Object of the present invention is to provide a screen that is adapted to separate, within such residues, a part thereof represented by light materials such as: "sheet materials", with such expression it being intended thin materials such as plastic sheets, plastic bags or materials provided with a mainly sheet-like extension and for such reason provided with a low weight in relation to a large surface area thereof, hence susceptible to high friction with air; and preferably also "expanded materials", with such expression it being intended very light materials obtained by incorporating much air in the volume of the material, such as spongy or polystyrene materials and generally materials with density comprised between 15 $kg/m^3$ and 40 $kg/m^3$.

In particular, advantageously, the screen according to the present invention is intended to be mainly employed for separating homogenous plastic material and even more particularly homogeneous plastic material which appears in sheet form.

The screen according to the invention is therefore inserted in the industrial field of treatment of solid residues and is advantageously intended to be installed downstream of plants for crushing and grinding the same residues.

Hereinbelow, reference will be made to the preferred embodiment illustrated in the drawings, i.e. to a screen 1 of disc type, it being nevertheless intended that the screen according to the invention can also be of another type (e.g. vibrating mesh screen or screw screen, or of rotary type) without departing from the protective scope of the present patent.

The screen according to the invention, as specified hereinbelow, can be obtained starting from a simple belt or mesh conveyor.

Figure 3:
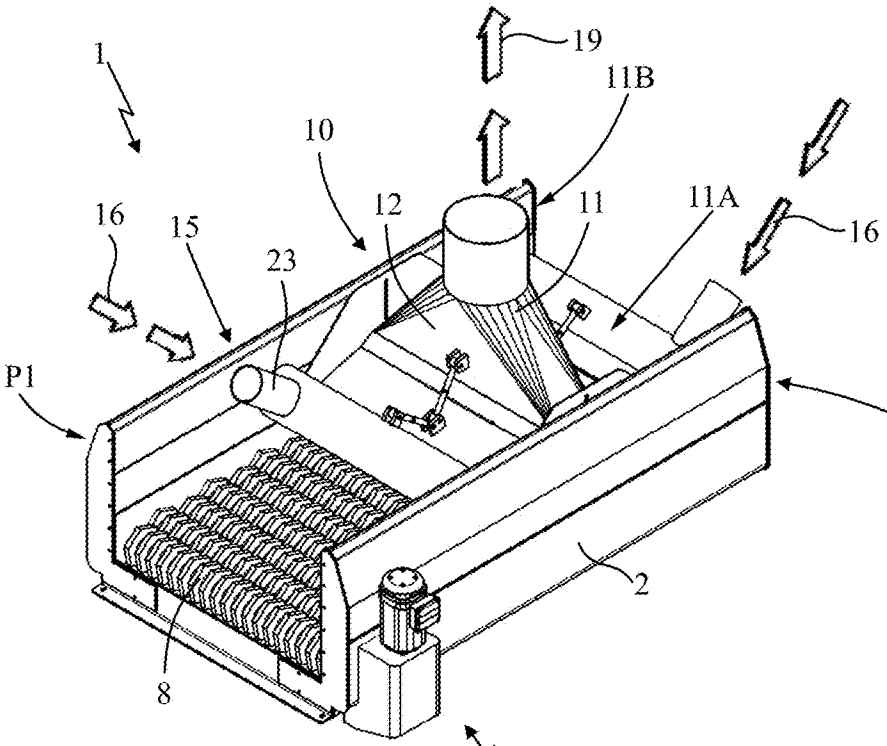
FIG. 3 schematically shows, in top perspective view, an image of the screen for separating solid materials, according to the present invention with some parts removed in order to better illustrate other parts.
Figure 6:
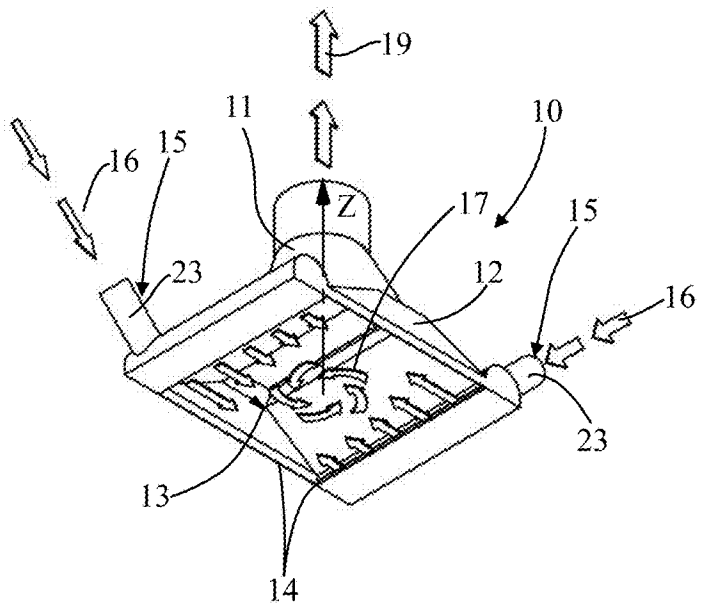
FIG. 6 shows an enlarged detail of the screen of FIG. 1, object of the present invention, in a bottom perspective view relative to a suction hood with air insufflation means associated therewith.

The screen 1 comprises, in the different possible embodiments, movement means 4 adapted to make the residues advance on a screening surface P (see FIG. 3) between an inlet port P1 and an outlet port P2 along an advancement direction A of the screen 1 itself.

During their advancement on the screening surface P, the residues with size smaller than the openings defined by the screen fall by gravity below the screening surface P, .obtaining the selection of the materials as a function of their size.

More in detail, in the case of disc screen 1, as schematically represented in the enclosed figures, a support structure 2 is provided, intended to abut against the floor; on such support structure 2, a plurality of rotating shafts 3 are rotatably mounted that are parallel and spaced from each other, as in particular can be appreciated from the image of FIG. 2 which represents a plan view of the screen.

The rotating shafts 3 have longitudinal extension axes, indicated with Y in FIG. 2, which define a preferably horizontal position (parallel to the screening surface P), as illustrated in the drawings, but which can also assume a tilt without departing from the protective scope of the present patent.

The rotating shafts 3 are then flanked in succession along the advancement direction A of the residues from the inlet port P1 to the outlet port P2 and are rotated in a same direction by the movement means 4.

The movement means 4 advantageously comprise an electric motor and motion transmission means mechanically connected to the electric motor, and in turn for example obtained with a chain wound as a closed loop, engaged with a pinion fixed to the shaft of the motor and to a plurality of toothed wheels, each fit on a corresponding rotating shaft.

The screen 1 also comprises, in accordance with the preferred embodiment (but not limiting) represented in the drawings, a plurality of discs 8, which are axially mounted in succession along the rotating shafts 3 in order to receive the rotation motion therefrom.

Due to the disc screen, the residues advance in a jerking manner on the screening surface P, such that when they arrive at the vortex 17, the sheet or expanded materials, e.g. plastic bags or parts of plastic bags, polystyrene, spongy material or another light material are easily separated.

Therefore, the present invention synergistically has an optimal operation, with the use of a screening surface formed by a vibrating screen, in particular a disc screen, which advances the material to be separated in a jerking manner.

The screen 1 hence defines, through the plurality of discs 8, the aforesaid screening surface P on which the residues to be screened are loaded, by means of a belt or hopper conveyor; such residues to be screened contain the sheet or expanded material that is to be separated.

In the case of the embodiment represented in the enclosed figures, the screening surface P is obtained with the discs 8; otherwise, it could be obtained with a mesh, in particular for example vibrating or even by the abutment surface of a conveyor belt (e.g. mesh) without vibration means, solutions not represented in detail since they are well known to the man skilled in the art.

In the case of a vibrating mesh screen, the movement means provide for arranging the mesh in tilted position on the support structure, such that the residues can advance by gravity, jerking along the vibrating mesh.

In the case of screen obtained with a simple conveyor belt, the movement means must be intended the motor and the relative transmission means adapted to make the conveyor, wound as a loop, advance on end pulleys or rollers of which at least one is preferably powered.

The solutions of disc screen, vibrating mesh screen and conveyor belt screen have in common the presence of a rigid structure (discs, vibrating mesh, mesh conveyor belt) which also defines, above the screening surface P on which the residues advance and in the case of mesh conveyor belt, the presence of openings for the passage of the residues of reduced size with respect to the screening area.

More in detail, in accordance with the aforesaid embodiment schematically illustrated in the drawings, the discs 8 of each group of discs are mounted spaced from each other along the extension of the longitudinal axis Y of the rotating shaft 3.

The disc screen 1 is also provided, in a manner per se well known to the man skilled in the art, with a plurality of sleeves, each of which comprising a tubular body mounted externally idle on a respective rotating shaft between two successive discs.

The discs 8 are otherwise mechanically and rotatably coupled to the rotating shaft 3 in order to receive the rotation motion therefrom.

For such purpose, the rotating shaft 3 for example has a male-shaped profile, e.g. polygonal, defined by the shape of its external surface and in particular by its transverse section, and the disc has a through hole with a female-shaped profile of corresponding form mated to the aforesaid male-shaped profile in a manner such that, due to the aforesaid shape engagement, is thus susceptible of being rotated.

Preferably, each disc 8 has the shape of a hexagonal polygonal prism having six external flat faces that facilitate the advancing of the to be screened during the rotation of the shafts 2. In other embodiments of the present invention, the discs 8 can also have external profiles with different shape, advantageously adapted to facilitate the advancing of the residues between the inlet port P1 and the outlet port P2.

Figure 1:
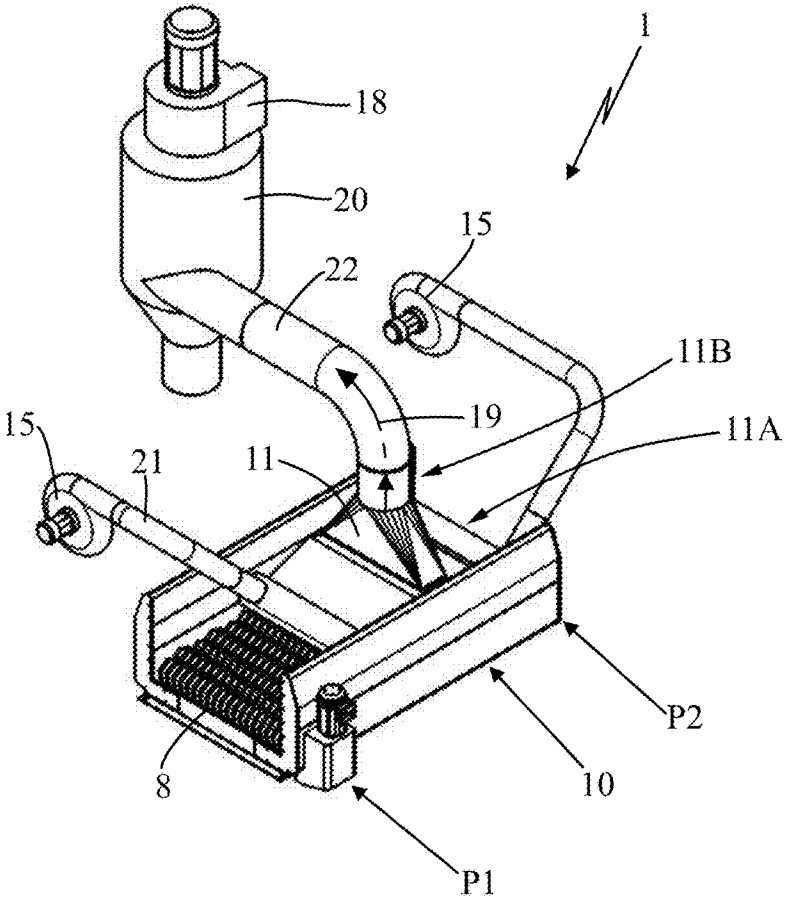
FIG. 1 schematically shows, in top perspective view, an image of the screen for separating solid materials, according to the present invention.
Figure 4:
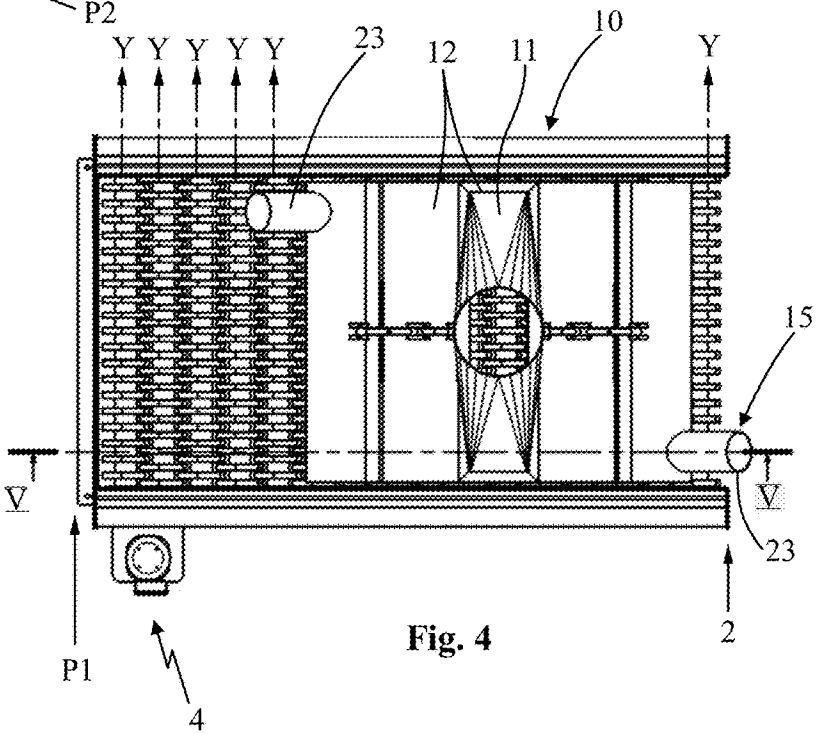
FIG. 4 shows the screen of FIG. 3 in a plan view.

In operation, when the screen 1 is operating, the motor by means of the chain, wound as a loop on the pinion of the shaft motor and on the toothed wheels, rotates the rotating shafts 3 in a same direction, and the hexagonal profile with flat surface of the discs 8 impacts with the residues, facilitating the advancing thereof via thrust along the screening surface P in the advancement direction indicated with A in FIGS. 1 and 2.

The advancing of the residues advantageously occurs by jerking, and this allows the sheet material, such as in particular plastic bags and films, or expanded material, such as polystyrene or sponges, to advance by floating (due to the friction with air) above the screening surface P without having the time (due to the friction with air) and the weight force necessary for passing through the screen area defined between the discs 8 and the rotating shafts 3 of the screening surface P.

During the advancement thereof, the residues of size smaller than the openings defined between the discs 8 and the sleeves fall by gravity below the screening surface, obtaining the selection of the materials as a function of the size thereof.

During the screening, the presence of the sleeves prevents, or at least limits, the winding of threadlike residues around the rotating shafts 3. Indeed, the sleeves do not follow the rotating shafts 3 during their rotation and are not integrally moved with the residues.

According to the idea underlying the present invention, the screen 1 comprises a separation. station 10 for separating the sheet or expanded material from the residues, which is interposed between the inlet port P1 and the outlet port P2 above the screening surface P.

More in detail, the separation station 10 comprises a hood 11, which delimits, with lateral walls 12, a suction chamber 13 that is extended with a suction mouth 14 substantially starting at the screening surface P.

The hood 11 has a lower portion 11A which is tapered upward until it is connected with an upper duct verso 11B with narrow section.

The lateral walls define a pyramid or conical shape that is tapered towards the top.

Figure 5:
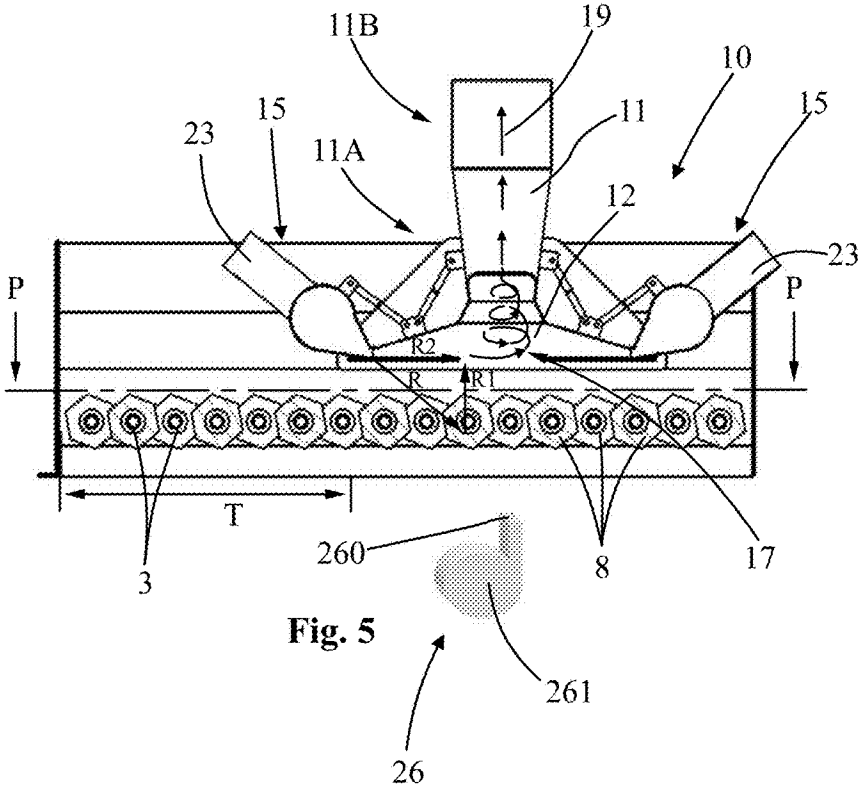
FIG. 5 shows the screen of FIG. 4 in a sectional side view made along line V-V of FIG. 4.
Figure 10B:
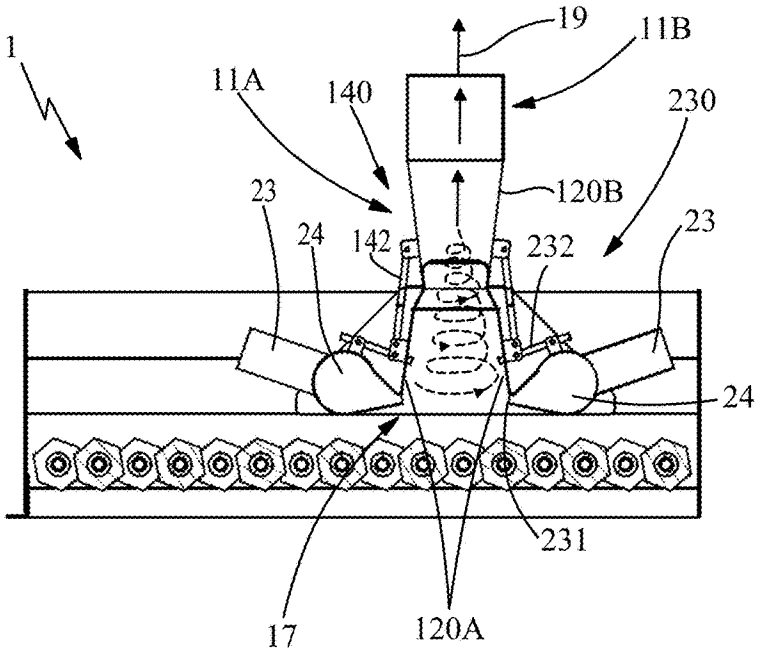
FIGS. 10A, 11A, 12A, 13A and FIGS. 10B, 11B, 12B, 13B show the hood mounted on the screen respectively in perspective and side views (the latter in longitudinal section) and with first adjustment means for adjusting the section of the hood suction mouth and second adjustment means for adjusting the direction of air insufflation means in the hood represented in different adjustment positions.

Insufflation means 15 are also provided, which inject in the suction chamber 13, at the screening surface P, one or more lifting air flows 16 which are oriented in order to form a vortex 17 having rotation axis Z orthogonal to the screening surface P. Such vortex is of ascensional type and is formed from the bottom upward (as shown in FIGS. 5 and 10B), substantially starting from the height of the screening surface P.

The insufflation means 15 comprise a blowing pump for each corresponding lifting flow 16, with flow rate for example of 2500-10000 $m^3/h$, mounted a corresponding injection tube 21 connected to the hood 11.

The separation station 10 also comprises suction means 18, associated with the hood 11 in order to extract, from the suction chamber 13, a suctioned air flow 19 containing at least one part of the lifting air flow 16 with the sheet or expanded material at its interior. The suction means suction from the upper duct 11B with narrow section of the hood 11, substantially from above the vortex 17 and preferably in a centered manner with respect to the extension axis thereof.

The suction means 18 for example comprise a suction pump, for example of 5000-20000 $m^3/h$ mounted on a suction tube 22 centred above the hood 11.

In operation, due to the aforesaid configuration according to the invention, the sheet or expanded material stressed by the lifting air flows 16 lifts the sheet or expanded material from the remaining residues, incorporating it in the air vortex 17 that continues its flow tube in the hood 11 in the suctioned air flow 19.

Once drawn from the hood 11, the sheet or expanded material is conveyed due to the suctioned air flow 19 to suitable separation means 20 (schematized in FIG. 3), of per se known type and for this reason not described in detail, which through the centrifugal three, i.e. by slowing the suctioned flow, separate the sheet or expanded material, making it fall into a suitable collection area.

Advantageously, the separation station 10 is placed after a first section T of the screening surface P. or after a certain number of rotating shafts 3. In such a manner, a first selection of the residues occurs which allows extracting therefrom the powder and material of smaller size that falls below the screening surface P.

Such operation advantageously allows the residues to reach the separation station 10 without those parts, such as fine powders or particles, which could be lifted together with the sheet or expanded material and which would come to compromise the efficiency of the separation, in addition to generating a cloud of powders susceptible of causing damage to the motors of the blowing and suction pumps of the separation station 10.

In accordance with the embodiment illustrated in the enclosed figures, the insufflation means 15 orient the lifting air flow 16, and preferably the at least two lifting air flows 16, in an injection direction that is offset with respect to the median longitudinal plane of the hood 11. in order to facilitate the formation of the vortex 17.

In such a manner, the air flows 16 confined by the lateral walls of the hood 11 generate the vortex 17. This originates from the direction and orientation of the air flows and from the shape of the walls of the hood 11.

The formation of the vortex is attainable by the man skilled in the art in numerous configurations which involve the orientation of the lifting air flows 16 and/or the lateral walls 120 for confining the hood 11.

The lateral walls 120 of the hood can be designed with conical shape in order to facilitate the circulation of the air, or they can have radial fins, e.g. with concavity directed towards the flow, in order to facilitate the formation of the vortex 17.

The insufflation means 15 can for example comprise one two or more injectors 23 adapted to introduce two corresponding lifting flows 16 arranged peripherally tangential to the vortex 17, i.e. with at least one tangential component.

For example, the insufflation means 15 can comprise at least two injectors 23 oriented with axis R, for introducing in the hood 11 corresponding tangential lifting air flows 16 along two injection directions that are transversely spaced from each other and offset with respect to the median longitudinal plane of the hood 11, as represented in the figures.

Preferably, each lifting air flow 16 will be tilted with respect to the screening surface P with one component orthogonal R1 and one parallel R2 to the surface P itself.

The orthogonal component R1 has the purpose of stressing the sheet or expanded material upward, shaking it with respect to the remaining residues.

The screening surface P provided with openings, due to the meshes of the net or preferably to the spaces between the shafts 3 and discs 8, allows the passage of part of the air of the lifting flows, facilitating the detachment of the sheets or expanded materials from the remaining mass of residues.

The component R2, parallel to the screening surface P and advantageously horizontal, has the purpose of creating the vortex 17 which carries the sheet or expanded material in a jerking manner on the screening surface P itself, in particular due to the action of the discs 8 having polygonal peripheral profile, to be lifted and then easily suctioned in the hood 11.

In order to finely adjust the suction power of the hood 11, it will be possible—in addition to adjusting the speed of the suction pump—to also preferably adjust the section of the suction mouth 14 of the hood 11. For example, this can be obtained by means of first adjustment means 140, which move closer and apart the lower edges of the transverse walls 120' of the walls 120 of the hood 14. Advantageously for such purpose such first adjustment means 140 provide that each of the transverse walls 120' is formed by at least one movable final portion 120A pivoted with hinge 141 to a fixed portion 120B such that the movable final portion 120A can be tilted in a variable manner with respect to the fixed portion 120B, obtaining a mouth 14 of the hood 11 of variable width. For such purpose, the first adjustment means 140 comprise at least one first support rod 142 which connects the two portions 120A 120B of transverse wall 120' in an adjustable manner, screws being provided that associate such rod in different positions with the same two portions.

By varying the tilt of the movable portion 120A, it will be possible to modify the width of the mouth 14 of the hood 11, tightening and opening the longitudinal length L of the suction mouth 14 of the hood 11 as schematically indicated in FIGS. 7A-7C.

Figure 10A:
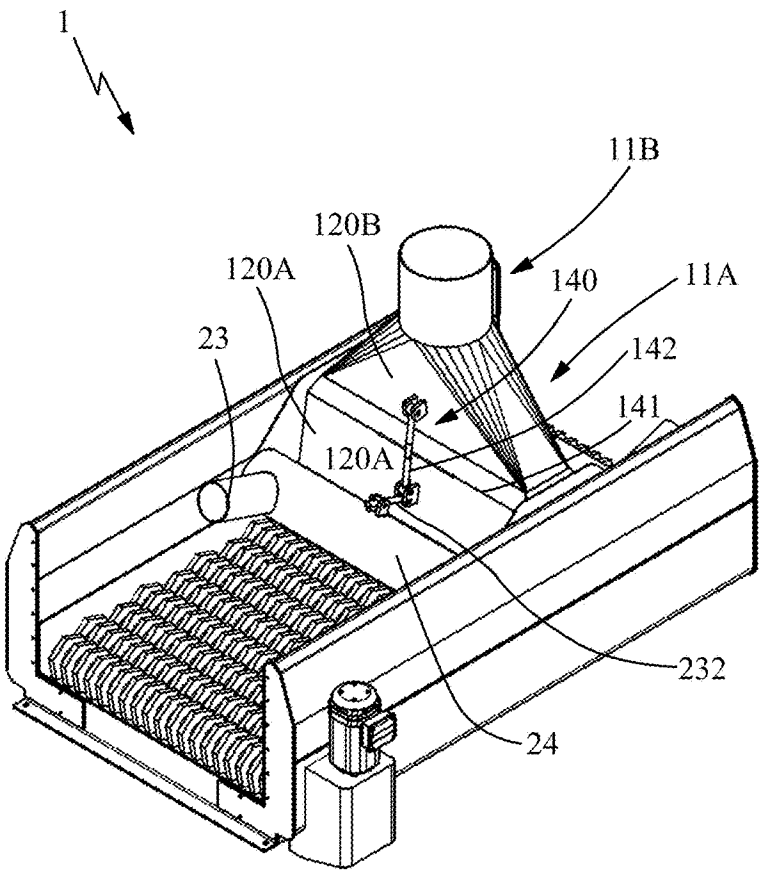
Figure 11B:
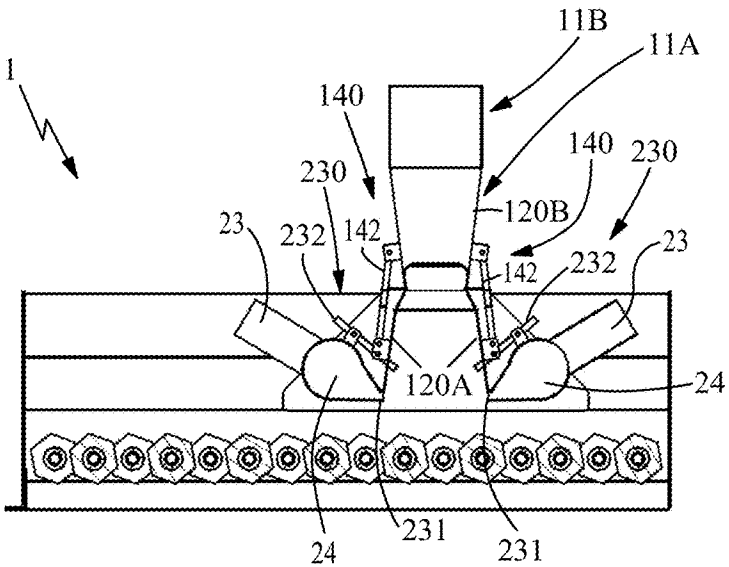
Figure 11A:
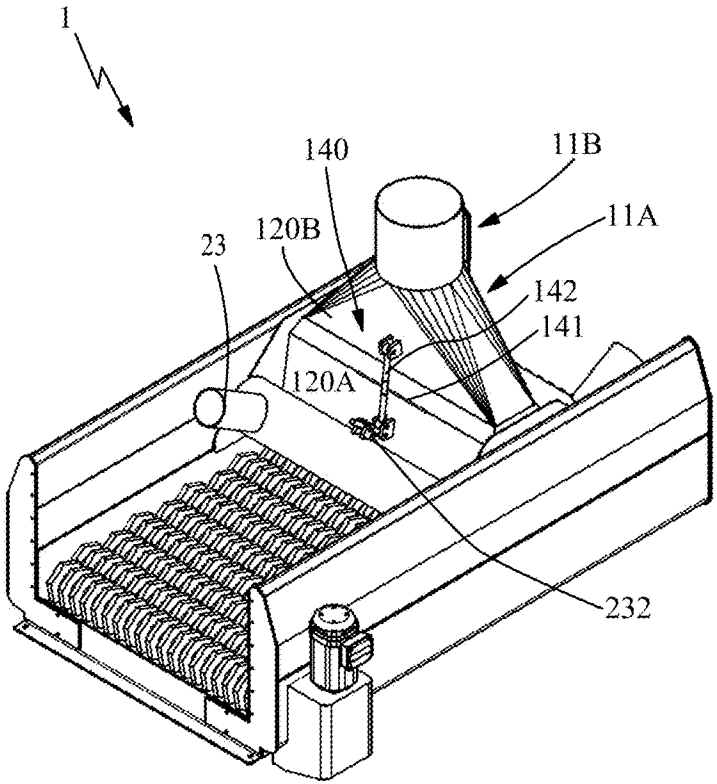
Figure 12B:
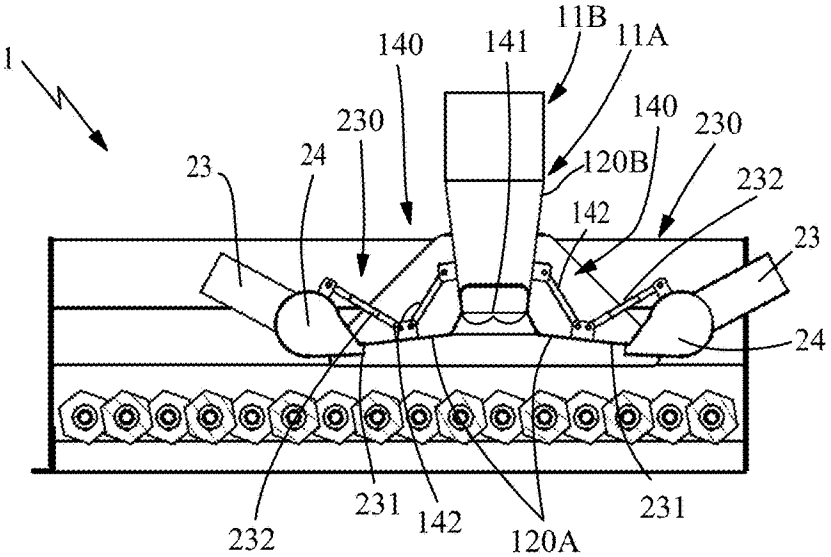
Figure 12A:
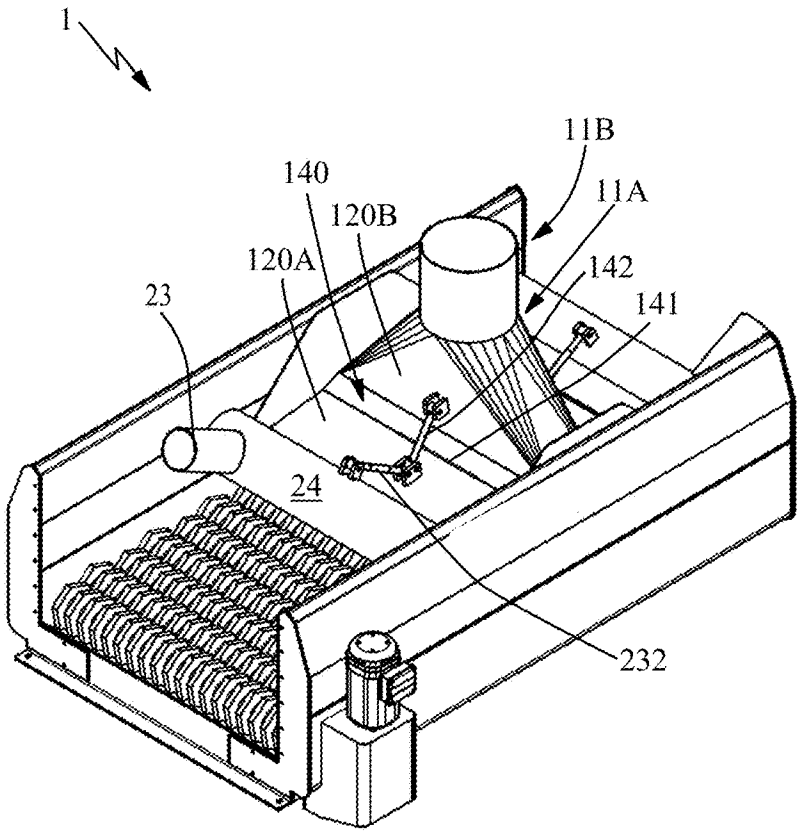
Figure 13B:
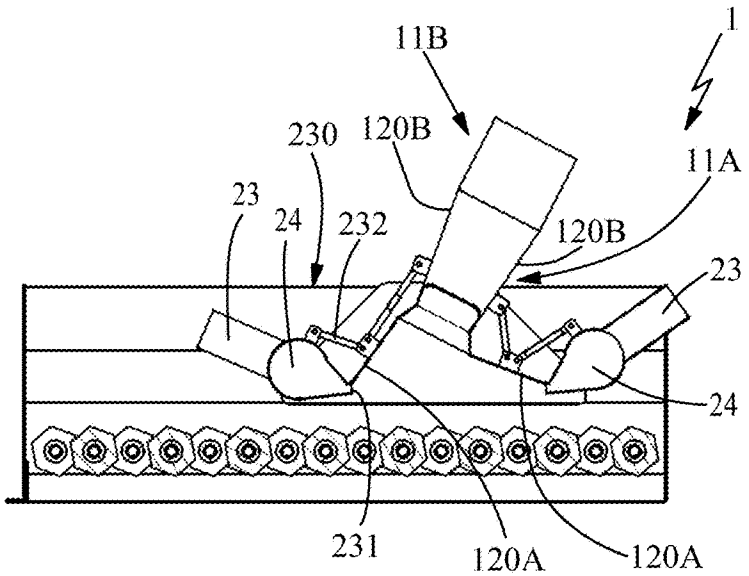
Figure 13A:
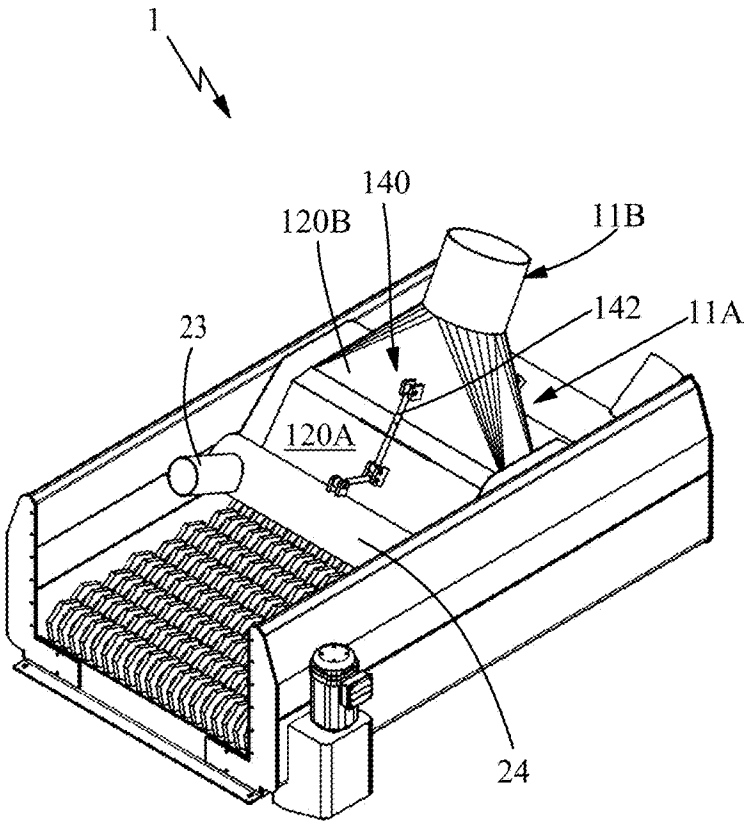

Each injector 23 connected to the hood 11 can also be provided with tilt R that can be adjusted with respect to the screening surface P; for such purpose, second adjustment means 230 are provided for orienting the injector 23 in the desired angular position. In accordance with the embodiments of FIGS. 10-12, such second adjustment means 230 provide for a second connection hinge 231 between each injector 23 and the corresponding lateral wall 120 (lateral wall arranged transverse to the advancing of the residues) and a second support rod 232 which connects the injector 23 with the wall 120 in an adjustable manner, screws being provided that associate such rod in different positions respectively e injector 23 and with the wall 120.

By varying the tilt of the injector 23, it will be possible to modify the two orthogonal R1 and horizontal R2 components aimed to adjust the lifting conditions of the sheet or expanded material in accordance with the different conditions (e.g. more or less wet residues) and with the different residues to be treated (see FIGS. 7A-7C).

Advantageously each injector 23 comprises a transverse manifold 24, which is substantially extended for the entire length of the screening surface P, orthogonal to the advancement direction A. The support rod 232 is connected, as can be appreciated in the enclosed figures, to the manifold 24 of the injector 23.

The manifold 24 is provided with at least one air insufflation opening 25 in the hood 11. Such opening 25 is susceptible of introducing the lifting air flow 16 in an offset manner with respect to the center of the hood 11 itself, as explained above for making the vortex 17.

The opening 25 will for such purpose be advantageously provided with a section that is narrowed from one side to the other of the screening surface P as illustrated in FIG. 7C or will be provided with larger or more holes at one side of the screening surface P as illustrated in FIG. 7A, or it will have constant section from one side to the other as illustrated in FIG. 7B, given that at the side where the injector is connected to the manifold 24, there will be a greater flow rate of air that is offset, i.e. asymmetric, with respect to a transverse plane.

In accordance with a preferred embodiment of the present invention illustrated in FIG. 5, the screen 1 also comprises second insufflation means 26 arranged below the screening surface P at the hood 11 adapted to make an air flow flow through the openings of the screening surface from the bottom upward, in order to assist the lifting of the sheet or expanded material. Such insufflation means 26 advantageously comprise a perforated tube 260 transversely mounted below the screening surface P with the holes directed upward, and a blower 261 connected to the aforesaid perforated tube 260.

The finding thus conceived therefore achieves the preestablished objects.

In particular, the invention allows separating sheet material, such as in particular that deriving from plastic bags or plastic belts or plastic sheets, or advantageously also separating expanded material such as polystyrene or sponges, from the remaining part of residues by exploiting the action of a vortex which is created at the screening surface P by one or more injectors 23.

The invention claimed is:

1. A screening and separation system for separating solid residues, which comprises:

a support structure (2);

a screening surface (P) intended to receive the solid residues to be screened and provided with an inlet port (P1) and an outlet port (P2);

movement means (4) adapted to make said residues advance between said inlet port (P1) and said outlet port (P2) along an advancement direction (A);

wherein the screening and separation system comprises a separation station (10) for separating sheet or expanded material from said residues, interposed between said inlet port (P1) and said outlet port (P2) above said screening surface (P), which comprises:

at least one hood (11) delimiting a suction chamber (13) extended substantially starting from said screening surface (P);

insufflation means (15) for insufflating in said suction chamber (13), which insufflate at least one lifting air flow (16) substantially at said screening surface (P); said lifting air flow (16) being oriented to form a vortex (17) starting from said screening surface (P) confined in said suction chamber (13) and with rotation axis (Z) orthogonal to said screening surface (P), in order to lift said sheet or expanded material from said screening surface (P);

suction means (18) associated with said hood (11) in order to suction from said suction chamber (13), above said vortex (17), a suctioned air flow (19) containing at least one part of said lifting air flow (16) with said sheet or expanded material at its interior; wherein said insufflation means (15) comprise at least two injectors (23) for introducing, in said hood (11), two corresponding lifting air flows (16) tangential to the vortex (17), along two injection directions (R) that are transversely spaced from each other and offset with respect to a median longitudinal plane of said hood (11).

2. The screening and separation system for separating solid residues according to claim 1, wherein said insufflation means (15) orient said at least one lifting air flow (16) in at least one injection direction (R) that is offset with respect to a median longitudinal plane of said hood (11).

3. The screening and separation system for separating solid residues according to claim 1, wherein said at least one lifting air flow (16) is tilted with respect to said screening surface (P) with one component orthogonal (R1) to said screening surface (P) and with one component parallel (R2) to said screening surface (P).

4. The screening and separation system for separating solid residues according to claim 1, wherein said hood (11) is provided with a suction mouth (14) with adjustable section.

5. A screening and separation system for separating solid residues, which comprises:

a support structure (2);

a screening surface (P) intended to receive the solid residues to be screened and provided with an inlet port (P1) and an outlet port (P2);

movement means (4) adapted to make said residues advance between said inlet port (P1) and said outlet port (P2) along an advancement direction (A);

wherein the screening and separation system comprises a separation station (10) for separating sheet or expanded material from said residues, interposed between said inlet port (P1) and said outlet port (P2) above said screening surface (P), which comprises:

at least one hood (11) delimiting a suction chamber (13) extended substantially starting from said screening surface (P);

means for insufflating (15) in said suction chamber (13), which insufflate at least one lifting air flow (16) substantially at said screening surface (P); said lifting air flow (16) being oriented to form a vortex (17) starting from said screening surface (P) confined in said suction chamber (13) and with rotation axis (Z) orthogonal to said screening surface (P), in order to lift said sheet or expanded material from said screening surface (P);

suction means (18) associated with said hood (11) in order to suction from said suction chamber (13), above said vortex (17), a suctioned air flow (19) containing at least one part of said lifting air flow (16) with said sheet or expanded material at its interior;

wherein said insufflation means (15) comprise at least one injector (23) connected to said hood (11) with adjustable tilt (R).

6. The screening and separation system for separating solid residues according to claim 5, wherein said at least one injector (23) comprises a transverse manifold (24) provided with at least one opening (25).

7. The screening and separation system for separating solid residues according to claim 1, further comprising second insufflation means (26) arranged below the screening surface (P) at said hood (11) adapted to make an air flow flow through the openings of said screening surface (P).

8. The screening and separation system for separating solid residues according to claim 1, further comprising:

a plurality of rotating shafts (3) parallel to each other and rotatably mounted on said support structure (2);

power means (4) for said rotating shafts (3) in order to rotate them around the longitudinal extension axis (Y) thereof;

a plurality of discs (8), provided with polygonal perimeter profile, axially mounted in spaced succession from each other along said rotating shafts (3), defining said screening surface above.

9. The screening and separation system for separating solid residues according to claim 8, wherein said separation station (10) is placed after a first section (T) of the screening surface (P) in which a first selection of the residues occurs.

* * * * *